US010350879B2

(12) United States Patent
Cutcher, Jr. et al.

(10) Patent No.: US 10,350,879 B2
(45) Date of Patent: Jul. 16, 2019

(54) SCREEN PRINTING APPARATUS AND METHODS

(71) Applicant: CORNING INCORPORATED, Corning, NY (US)

(72) Inventors: Thomas Cutcher, Jr., Berkey, OH (US); Christopher Paul Daigler, Painted Post, NY (US); Christina Marie Laskowski, Painted Post, NY (US); Kevin Ray Maslin, Athens, PA (US)

(73) Assignee: CORNING INCORPORATED, Corning, NY (US)

( * ) Notice: Subject to any disclaimer, the term of this patent is extended or adjusted under 35 U.S.C. 154(b) by 0 days.

(21) Appl. No.: 15/500,385

(22) PCT Filed: Jul. 31, 2015

(86) PCT No.: PCT/US2015/043169

§ 371 (c)(1),
(2) Date: Jan. 30, 2017

(87) PCT Pub. No.: WO2016/019274

PCT Pub. Date: Feb. 4, 2016

(65) Prior Publication Data

US 2017/0217151 A1 Aug. 3, 2017

Related U.S. Application Data

(60) Provisional application No. 62/032,156, filed on Aug. 1, 2014.

(51) Int. Cl.
*B41F 15/38* (2006.01)
*B41F 15/08* (2006.01)
(Continued)

(52) U.S. Cl.
CPC ..... *B41F 15/38* (2013.01); *B41F 15/0895* (2013.01); *B41F 15/36* (2013.01);
(Continued)

(58) Field of Classification Search
CPC ..... B41D 15/108; B41D 15/36; B41D 15/38; B41D 15/40; B41D 15/42; B41D 15/44;
(Continued)

(56) References Cited

U.S. PATENT DOCUMENTS 4,381,706 A 5/1983 Harpold
4,509,455 A * 4/1985 Shirataki ..... G03F 7/12 101/123

(Continued)

FOREIGN PATENT DOCUMENTS

AT 507706 7/2010
CN 102785464 A 11/2012

(Continued)

OTHER PUBLICATIONS

International Search Report and Written Opinion of the International Searching Authority; PCT/US2015/043169; dated Oct. 13, 2015.

(Continued)

*Primary Examiner* — Matthew G Marini
*Assistant Examiner* — Marissa Ferguson-Samreth

(57) ABSTRACT

Disclosed herein are apparatuses for screen printing on a surface of a three-dimensional substrate comprising a substantially rigid, substantially planar frame having a perimeter defining a region within the perimeter having a given surface area; and a screen attached to the frame and extending across at least a portion of the surface area, wherein the screen comprises a first portion through which a liquid printing medium can pass onto a proximate three-dimensional substrate; and a second portion coated with an emul-
(Continued)

sion substantially preventing the liquid printing medium from passing through the second portion of the screen, wherein the screen has a fixed tension of less than about 20 N/cm. Methods and systems for screen printing on a surface of a three-dimensional substrate are also disclosed herein.

22 Claims, 5 Drawing Sheets

(51) Int. Cl.

| | |
|---|---|
| ***B41F 15/36*** | (2006.01) |
| ***B41M 1/12*** | (2006.01) |
| ***B41M 1/40*** | (2006.01) |
| ***B41F 15/44*** | (2006.01) |
| ***B41F 17/00*** | (2006.01) |
| *B41N 1/24* | (2006.01) |

(52) U.S. Cl.
CPC ..... *B41F 15/44* (2013.01); *B41F 17/00* (2013.01); *B41M 1/12* (2013.01); *B41M 1/40* (2013.01); *B41N 1/247* (2013.01); *B41P 2215/12* (2013.01)

(58) Field of Classification Search
CPC ..... B41D 17/00; B41F 15/108; B41F 15/36; B41F 15/38; B41F 15/40; B41F 15/42; B41F 15/44; B41F 17/00; B41F 15/0895; B41M 1/12; B41M 1/40; B41N 1/247; B41P 2215/12
See application file for complete search history.

(56) References Cited

U.S. PATENT DOCUMENTS

| | | | | |
|---|---|---|---|---|
| 4,981,076 | A | 6/1991 | Cunill | |
| 5,170,703 | A | 12/1992 | Tu et al. | |
| 5,220,867 | A | 6/1993 | Carpenter | |
| 5,265,534 | A | 11/1993 | Hamu | |
| 5,339,732 | A | 8/1994 | Peterlini et al. | |
| 5,460,679 | A * | 10/1995 | Abdel-Kader | B29C 67/08 156/275.5 |
| 5,463,948 | A | 11/1995 | Newman | |
| 5,598,776 | A | 2/1997 | Casl | |
| 5,685,221 | A * | 11/1997 | Newman | B41F 15/44 101/123 |
| 5,743,182 | A | 4/1998 | Kobayashi et al. | |
| 5,867,882 | A | 2/1999 | Karlyn et al. | |
| 6,041,702 | A | 3/2000 | Ichikawa et al. | |
| 6,698,345 | B2 | 3/2004 | Cutcher | |
| 7,182,019 | B2 | 2/2007 | Cutcher et al. | |
| 7,381,706 | B2 | 6/2008 | Minakata et al. | |
| 2005/0160927 | A1 * | 7/2005 | Cutcher | B41F 15/0895 101/127.1 |
| 2008/0022994 | A1 | 1/2008 | Hutchinson et al. | |
| 2008/0202364 | A1 | 8/2008 | Mallory et al. | |
| 2009/0016719 | A1 | 1/2009 | Lee et al. | |
| 2009/0101027 | A1 | 4/2009 | Goetz et al. | |
| 2009/0169719 | A1 | 7/2009 | Orr | |
| 2009/0314179 | A1 | 12/2009 | Kumar | |
| 2011/0209634 | A1 * | 9/2011 | Sabia | B41F 15/0895 101/129 |
| 2013/0139710 | A1 * | 6/2013 | Goetz | B41F 15/44 101/114 |

FOREIGN PATENT DOCUMENTS

| | | | |
|---|---|---|---|
| DE | 933676 | | 9/1955 |
| DE | 1258875 | B | 1/1968 |
| DE | 3227626 | A1 | 1/1984 |
| DE | 29500856 | U1 | 5/1995 |
| EP | 0099587 | | 2/1984 |
| EP | 0511605 | | 11/1992 |
| EP | 0727309 | | 8/1996 |
| JP | 60210454 | | 10/1985 |
| JP | 6340054 | | 12/1994 |
| KR | 2009090682 | | 8/2009 |
| KR | 1139101 | | 4/2012 |
| WO | 2008152866 | | 12/2008 |
| WO | 2009088867 | | 7/2009 |
| WO | 2016019245 | A1 | 2/2016 |

OTHER PUBLICATIONS

International Search Report and Written Opinion of the International Searching Authority; PCT/US2015/043114; dated Feb. 4, 2016.

English Translation of CN201580053449.7 First Office Action dated Jun. 19, 2018, China Patent Office, 10 pgs.

* cited by examiner

SCREEN PRINTING APPARATUS AND METHODS

CROSS-REFERENCE TO RELATED APPLICATIONS

This application claims the benefit of priority under 35 U.S.C. § 365 of International Patent Application Ser. No. PCT/US15/43169 filed on Jul. 31, 2015, which also claims the benefit of priority under 35 U.S.C. § 119 of U.S. Provisional Application Ser. No. 62/032,156 filed on Aug. 1, 2014 the content of which is relied upon and incorporated herein by reference in its entirety.

FIELD OF THE DISCLOSURE

The disclosure relates generally to methods and apparatuses for printing a pattern on three-dimensional substrates, and more particularly to screen printing methods and apparatuses for printing on substrates having one or more curved surfaces.

BACKGROUND

Three-dimensional (3D) screen printing is widely used in various industries, e.g., for printing on rounded containers such as bottles and cans. 3D screen printing as yet is generally limited to substrates with a smaller radius of curvature (e.g., less than about 500 mm) and/or a single axis of curvature. For the most part, 3D printing is also limited to printing on the outside, or convex, surface of semi-circular or parabolic substrates and cylindrical substrates with circular or oval cross-sections. These substrates can typically comprise glass (e.g., bottles, mugs, glasses, etc.), plastic (e.g., containers, etc.), and/or metal (e.g., cans, castings, etc.).

The ability to screen print on larger format, larger radius, and/or multiple radius three-dimensional substrates is increasingly relevant to various industries, such as the automotive industry. Larger format 3D substrates conventionally can be printed while the substrate is still flat, followed by shaping of the substrate to achieve a 3D shape, e.g., by softening a glass or plastic substrate at elevated temperatures, or the like. However, because the printing medium can be thermally incompatible with the conditions necessary to shape the substrate after printing, there is a growing need to print on curved surfaces of large format 3D substrates. This is particularly true in the case of glass substrates, which can be heated to relatively high forming or softening temperatures during the shaping process.

Current methods for decorating the surfaces of a 3D substrate include masking a portion of the surface and spray coating the substrate to create an image; however, such methods can be costly and/or time consuming and generally do not provide a suitable image resolution. Screen printing and inkjet printing on large format curved surfaces have been attempted, but with various drawbacks, complications, and/or limitations. For instance, 3D printing devices typically comprise one or more extra moving parts as compared to 2D printing devices for purposes of maintaining an "off-contact" distance, or gap, between the substrate and the screen mesh. 2D flat screen printing processes generally maintain a constant off-contact distance ranging from about 1 to about 10 mm, depending on the printing application. 3D printing devices conventionally compensate for off-contact variability by articulating the substrate under the screen or articulating the screen above or around a fixed substrate.

Screen frames with flexible sides can also be used, such that the frame and mesh can conform somewhat to the contour of the curved substrate during printing. Screen frames pre-shaped to match the curvature of a given substrate can also be used. Devices used to tension and detension the screen mesh can also be attached to a screen frame to allow the mesh to conform or flex during the printing process. However, these additional components and/or features of the screen frame and/or printing machine can add to the complexity and/or expense of the 3D printing process, as the printing machines and/or their individual components often have to be custom tailored to achieve each desired feature. Moreover, such 3D screen printing methods can be used only for convex or concave surface printing, not both, and only for substrates with a single radius of curvature.

Accordingly, it would be advantageous to provide methods and apparatuses for screen printing 3D substrates, which can operate with fewer moving parts, at lower cost, and/or with lower complexity. It would additionally be advantageous to provide methods and apparatuses for printing on a variety of substrate shapes, such as concave and/or convex substrates, and/or substrates with a complex curvature, e.g., curvature around plural radii. Furthermore, to reduce manufacturing costs and/or the need to custom make the printing device and/or its components, it may be advantageous to provide an apparatus that can function, at least in part, in conjunction with existing components for printing traditional (e.g., 2D) substrates.

SUMMARY

The disclosure relates, in various embodiments, to apparatuses for screen printing on a surface of a three-dimensional substrate, the apparatuses comprising a substantially rigid, substantially planar frame having a perimeter defining a region within the perimeter having a given surface area; and a screen attached to the frame and extending across at least a portion of the surface area, the screen comprising a first portion through which a liquid printing medium can pass onto a proximate three-dimensional substrate; and a second portion coated with an emulsion substantially preventing the liquid printing medium from passing through the second portion of the screen, wherein the screen has a fixed tension of less than about 20 N/cm. The disclosure also relates to systems for screen printing on a surface of a three-dimensional substrate, the systems comprising a framed screen apparatus as disclosed herein, and an applicator for applying a liquid printing medium to the three-dimensional substrate.

The disclosure further relates to methods for screen printing on a surface of a three-dimensional substrate, the methods comprising positioning the three-dimensional substrate in proximity to a framed screen apparatus as disclosed herein; applying a liquid printing medium to the screen; and applying pressure to the screen to force the liquid printing medium through at least a portion of the screen, wherein the distance between the frame and the three-dimensional substrate is held substantially constant during the application steps.

The disclosure further relates, in various embodiments, to squeegee apparatuses comprising a squeegee blade, a plurality of retainers spaced along a length of the squeegee blade and coupled to the squeegee blade, at least one support strip coupled to the plurality of retainers and extending along the length of the squeegee blade, and an actuating mechanism for applying a force to the squeegee blade in a direction substantially perpendicular to a print stroke direction. According to various embodiments, the at least one support strip comprises two opposing end surfaces and two opposing support surfaces, the opposing support surfaces being substantially perpendicular to the direction of force. Systems for screen printing on a surface of a substrate comprising the squeegee apparatus and a framed screen are also disclosed herein.

The disclosure further relates to methods for screen printing on a surface of a substrate comprising positioning the substrate in proximity to a framed screen apparatus comprising a frame having a perimeter defining a region within the perimeter having a given surface area, and a screen attached to the frame and extending across at least a portion of the surface area; applying a liquid printing medium to the screen; and applying pressure to the screen using the squeegee apparatus disclosed herein to force the liquid printing medium through at least a portion of the screen.

Additional features and advantages of the disclosure will be set forth in the detailed description which follows, and in part will be readily apparent to those skilled in the art from that description or recognized by practicing the methods as described herein, including the detailed description which follows, the claims, as well as the appended drawings.

It is to be understood that both the foregoing general description and the following detailed description present various embodiments of the disclosure, and are intended to provide an overview or framework for understanding the nature and character of the claims. The accompanying drawings are included to provide a further understanding of the disclosure, and are incorporated into and constitute a part of this specification. The drawings illustrate various embodiments of the disclosure and together with the description serve to explain the principles and operations of the disclosure.

BRIEF DESCRIPTION OF THE DRAWINGS

The following detailed description can be best understood when read in conjunction with the following drawings, where like structures are indicated with like reference numerals and in which.

DETAILED DESCRIPTION

Apparatuses

Disclosed herein are apparatuses for screen printing on a surface of a three-dimensional substrate, the apparatuses comprising a substantially rigid, substantially planar frame having a perimeter defining a region within the perimeter having a given surface area; and a screen attached to the frame and extending across at least a portion of the surface area, the screen comprising a first portion through which a liquid printing medium can pass onto a proximate three-dimensional substrate; and a second portion coated with an emulsion substantially preventing the liquid printing medium from passing through the second portion of the screen, wherein the screen has a fixed tension of less than about 20 N/cm.

As used herein, the term "three-dimensional substrate" and variations thereof is intended to denote a substrate having at least one non-planar and/or non-level surface, e.g., a surface with any given curvature, which may vary in size, shape, and/or orientation. A two-dimensional substrate, by contrast, comprises flat, planar, level surfaces, such as a flat sheet or a block.

Figure 1:
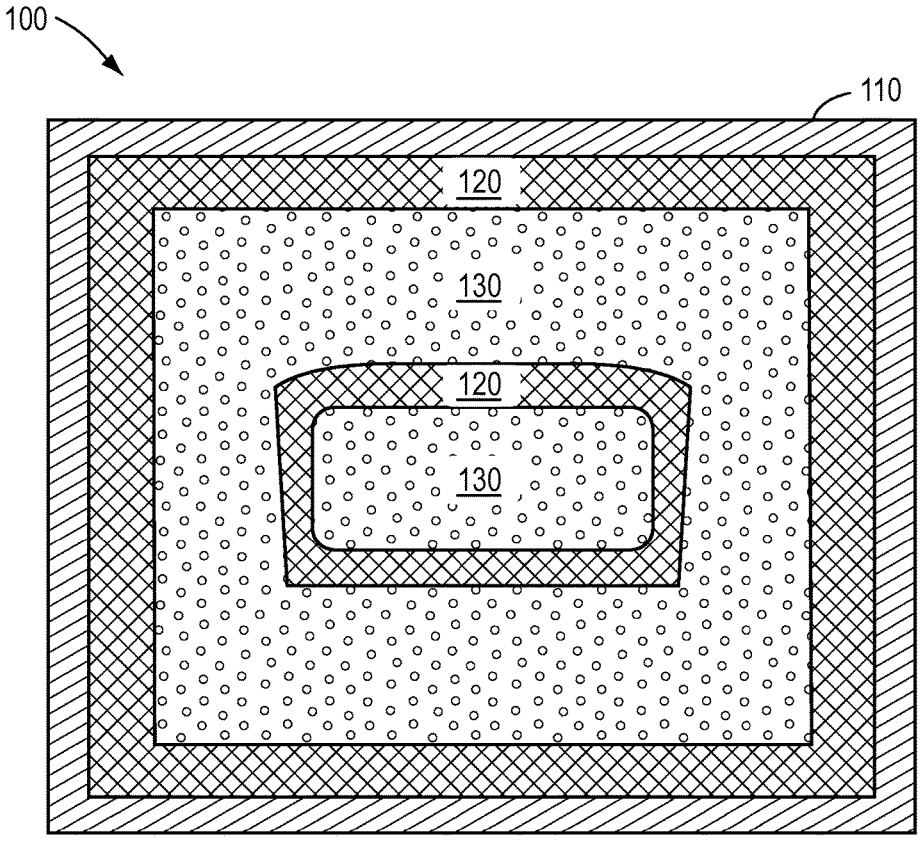
FIG. 1 illustrates a top view of an exemplary screen printing apparatus according to one embodiment of the disclosure.

With reference to FIG. 1, one embodiment of an exemplary screen printing apparatus 100 according to the disclosure is illustrated, which comprises a frame 110 and a screen 120. The screen 120 is partially coated with an emulsion 130 to form a pattern or image. In the illustrated embodiment, the pattern may correspond to a vehicle roof or sunroof, although various other shapes and applications are envisioned.

As used herein, the term "frame" is intended to denote the component forming a substantially rigid perimeter around the screen. The terms "screen," "mesh screen" and variations thereof are intended to denote a material extending across the frame and covering, at least in part, the surface area defined by the frame. As used herein, the terms "apparatus," "framed screen apparatus," "framed screen," and variations thereof are intended to denote the combined frame and screen components, e.g., the screen affixed to the frame, optionally with the addition of the emulsion.

The frame 110 may have any shape and size suitable for supporting a screen printing screen for a particular application. For instance, the frame may define a perimeter having a shape chosen from a square, rectangle, rhombus, circle, oval, ellipse, triangle, pentagon, hexagon, and other polygons, to name a few. According to various embodiments, the frame is four-sided, e.g., defining a square, rectangular, or rhomboid perimeter. The frame can be planar or substantially planar, and substantially rigid or inflexible. In other words, the frame is not shaped to conform to the curvature of the three-dimensional substrate before printing (substantially planar), and is not configured to conform to the curvature of the three-dimensional substrate during printing (substantially rigid).

The dimensions of the frame 110, e.g., length, width, diameter or height, depending on the geometry, can be of any size suitable to adequately stretch the screen to provide an acceptable print resolution. The size of the frame can vary, for example, based upon the screen material, mesh count, mesh type, desired screen tension, and/or the size of the three dimensional substrate. In certain embodiments, the frame can have at least one dimension that is approximately equal to or larger than the largest dimension of the three-dimensional substrate, for example, at least about 1.5 times the largest dimension of the substrate, or at least about 2 times the largest dimension of the substrate.

By way of non-limiting example, the cross-sectional dimensions of an exemplary four-sided frame can range from about 25 mm×25 mm up to about 200 mm×200 mm or more, depending, e.g., on the size of the printing device. For instance, an exemplary four-sided frame can have dimensions ranging from about 35 mm×35 mm up to about 150 mm×150 mm, such as from about 50 mm×50 mm up to about 100 mm×100 mm, or from about 60 mm×60 mm to about 80 mm×80 mm, including all ranges and subranges therebetween, and including both square and rectangular variations. According to at least one non-limiting embodiment the frame may be a rectangle having a width approximately equal to twice the height of the frame. For example, the frame can be a rectangle having width×height dimensions of approximately 50 mm×25 mm, 60 mm×30 mm, 76 mm×38 mm, 100 mm×50 mm, 150 mm×75 mm, or 200 mm×100 mm. In some embodiments, the frame may have at least one dimension in excess of 1 meter, such as several meters or more, such as two or three meters or greater.

The frame 110 can be constructed from a substantially rigid material, which can be chosen from any suitable material to which the mesh screen can be attached. Exemplary materials include, but are not limited to, wood and metals, such as aluminum, extruded or hollow aluminum, stainless steel, hollow stainless steel, and the like. According to one non-limiting embodiment, the frame can be constructed from aluminum, such as extruded aluminum, hollow aluminum, or a bent aluminum piece. The frame thickness can vary, depending on the structural integrity desired for a particular application. In various embodiments, the frame can have a thickness ranging from about 2 mm to about 5 mm, such as from about 3 mm to about 4 mm, including all ranges and subranges therebetween.

The screen 120 can comprise one or more porous, flexible mesh materials suitable for screen printing applications, for example, polyesters, nylons, PETs, polyamides, polyester core/sheath combinations, composite polyester materials, and coated polyesters, to name a few. According to certain embodiments, the screen is chosen from non-metal mesh materials. The screen material can optionally be chosen from monofilament materials. The screen may comprise a mesh material with any suitable weave including, but not limited to, plain, twill, double twill, crushed, and flattened weave patterns.

The mesh count of the screen can vary depending, for instance, on the frame size, mesh type, thread diameter, and/or desired screen tension. By way of non-limiting example, the mesh count can range from about 120 threads/inch to about 380 threads/inch, such as from about 230 threads/inch to about 305 threads/inch, including all ranges and subranges therebetween. In various embodiments, the mesh count may be variable across the screen. For example, the mesh count can be varied across the screen depending on the curvature of three-dimensional substrate, the desired features to be printed, their location on the substrate, and/or the desired resolution. According to exemplary embodiments, a finer mesh count can be used on portions of the screen aligning with targeted features to be printed along the radius of curvature of the three-dimensional substrate.

The screen 120 can comprise materials with any suitable thread diameter available for any mesh count, so long as the screen maintains adequate flexibility and printing resolution. In various non-limiting embodiments, the thread diameter of the screen can range from about 30 microns to about 80 microns, such as from about 40 microns to about 70 microns, or from about 50 microns to about 60 microns, including all ranges and subranges therebetween.

It is to be understood that the foregoing properties of the screen and frame can be chosen, independently or in combination, as desired by one skilled in the art, to achieve a framed screen apparatus with the desired attributes for a particular application. For example, these properties can be chosen to achieve a suitable screen flexibility or tension, as discussed in more detail herein. Such choices are within the ability of one skilled in the art and are intended to fall within the scope of the disclosure.

The screen 120 can be attached to the frame 110 using any means known in the screen printing art, for example, the screen can be adhered to the frame using an adhesive. According to various embodiments, the screen may or may not be biased to the frame before being attached to the frame. Adhesives can include, for example, ethylene vinyl acetate (EVA), thermoplastic polyurethane (TPU), polyester (PET), acrylics (e.g., acrylic pressure sensitive adhesive tape), polyvinyl butyral (PVB), ionomers such as SentryGlas® ionomer, pressure sensitive adhesives, double-sided tape, or any other suitable adhesive material. Alternatively, the screen may be attached to the frame using other methods, such as frictional forces, e.g., using clips, clamps, or the like.

The screen 120 as disclosed herein can be a flexible mesh, which can denote that the screen has a fixed, low tension before and/or after being attached to the frame 110. According to various embodiments, the screen can have a fixed tension of less than about 20 N/cm after being attached to the frame. For example, the mesh can have a fixed tension that is distributed uniformly across the mesh, in both the warp and weft directions of the weave, of less than about 20 N/cm, such as less than about 18 N/cm, less than about 15 N/cm, less than about 10 N/cm, or less than about 5 N/cm, including all ranges and subranges therebetween. According to various embodiments, the mesh can have a fixed, uniform tension ranging from about 10 N/cm to about 20 N/cm, such as from about 11 N/cm to about 19 N/cm, from about 12 N/cm to about 18 N/cm, from about 13 N/cm to about 17 N/cm, or from about 14 N/cm to about 16 N/cm, including all ranges and subranges therebetween. In other embodiments, a range of fixed low tensions can be applied in both the warp and weft directions of the weave, which can be less than about 20 N/cm, such as less than about 18 N/cm, less than about 15 N/cm, or less than about 10 N/cm. According to further embodiments, the mesh can have a fixed, variable tension ranging from about 10 N/cm to about 20 N/cm, such as from about 11N/cm to about 19 N/cm, from about 12 N/cm to about 18 N/cm, from about 13 N/cm to about 17 N/cm, or from about 14 N/cm to about 16 N/cm, including all ranges and subranges therebetween.

As used herein, the term "fixed" tension is intended to denote that the screen has a given tension, whether uniform or variable, across the mesh area, which is not changed, e.g., by devices used to tension and de-tension the screen mesh during the printing process. Without wishing to be bound by theory, it is believed that the relatively low tension of the screen material (e.g., 2D framed screens utilize screens with an as-manufactured tension of greater than 20 N/cm, such as up to about 40 N/cm), can allow for high tension during printing due to the stretch of the screen, which can result in higher resolution printing capability, while also allowing the screen to stretch as necessary to make contact with the various portions of the three-dimensional substrate.

The screen 120 can, in certain embodiments, comprise more than one porous mesh material, or one or more porous mesh materials in combination with another stretchable material. These embodiments will be discussed with non-limiting reference to FIG. 2, which illustrates an exemplary framed screen apparatus 100 comprising a screen constructed from two different materials. An outer screen region 120A constructed from a first screen material can be attached to the frame 110 and can extend across a first portion of the surface area defined by the frame. The first screen material can be attached to a second screen material defining an inner screen region 120B extending across a second portion of the surface area.

For example, the first screen material can have a given flexibility (or ability to stretch) and the second screen material can have a flexibility higher than that of the first material. By way of a non-limiting example, an outer region 120A can be formed from, e.g., a porous polyester mesh, whereas the inner region 120B can be formed from a higher stretch porous mesh material such as nylon. Alternatively, the first screen material can be a porous mesh having a given flexibility and the second screen material can be a porous mesh having a flexibility lower than that of the first material, such as an outer region 120A formed from nylon and an inner region 120B formed from polyester.

In a further embodiment, the first material forming the outer region 120A can be a non-porous, flexible material or a porous, stretchable material not typically used for screen printing, and the inner region 120B can be formed from a flexible, porous mesh material as described herein, such as polyester or nylon, to name a few, or vice versa. The non-porous material can be any flexible material of any suitable thickness appropriate for high resolution printing including, but not limited to, silicone membranes. The porous, stretchable materials not typically used for screen printing can include, for instance, Spandex and Lycra.

According to various embodiments, the outer and inner regions 120A and 120B can meet at a juncture 140, at which point they are adhered or otherwise attached to each other in any manner suitable to maintain the integrity between the two materials during printing (e.g., such that the two materials do not separate at the junction). In certain embodiments, the juncture 140 has a minimal thickness that does not interfere, or does not substantially interfere, with the printing process. For instance, the two materials may be joined together using liquid adhesives, which can be, e.g., thermal set or UV set adhesives, double-sided tape, or combination of both on either side and/or in between the two materials. In further embodiments, the juncture 140 can be positioned in proximity to the edge of the three-dimensional substrate to be printed such that the junction does not interfere with the screen printing of the surface. For example, the location of the juncture 140 can be chosen such that it does not interfere with the flood stroke or print stroke of the printing medium applicator, e.g., squeegee, during the printing process.

Figure 2:
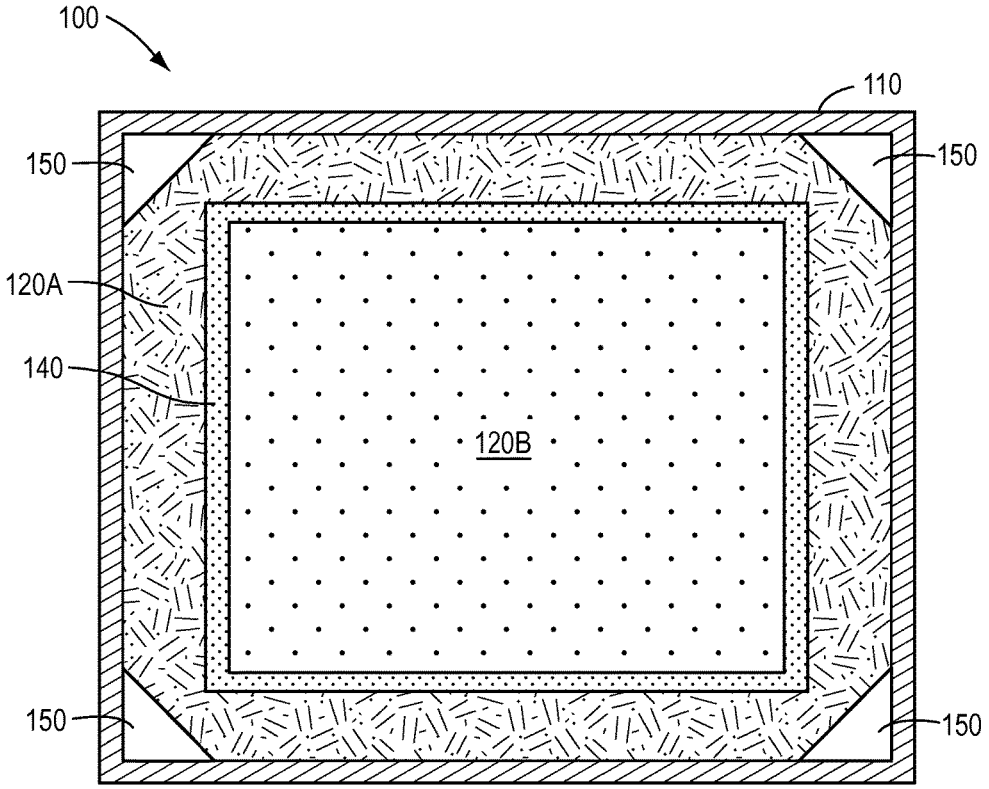
FIG. 2 illustrates a top view of an exemplary screen printing apparatus according to another embodiment of the disclosure.

While FIG. 2 illustrates one exemplary embodiment of a framed screen apparatus comprising two screen materials, it is to be understood that several variations can be made to this embodiment according to other aspects of the disclosure. For instance, more than two types of screen materials can be used and/or the shape and/or size of the frame and/or screen can be varied. Moreover, while an emulsion is not depicted on the screen 120 in FIG. 2, it is to be understood that such an emulsion can be present in any suitable pattern (see, e.g., FIG. 1).

It is also noted that in FIG. 2, the screen 120 does not fully cover the entire surface area defined by the frame 110, leaving voids 150 in the corners of the apparatus. In various embodiments, the screen 120 can cover more or less of the surface area and may have any desired shape, including one or more voids as depicted, in any quantity and/or location. By eliminating mesh in certain areas, it may be possible to reduce the resistance of the porous or non-porous material to stretching.

Further, while FIG. 2 illustrates an outer region 120A covering all sides of the frame perimeter, it is envisioned that the first screen material can be used to cover only a portion of the frame perimeter, for instance, only one, two, or three sides of the illustrated frame, or only portions of one or more sides, depending on the shape and/or radius or radii of the three-dimensional substrate to be printed. The variations of the size, shape, and/or number of such regions, including any voids, can vary depending on the frame and/or the substrate.

The screen 120 described herein can comprise one or more "porous" materials, which can denote that a liquid printing medium can pass through at least a portion of the screen upon application. For instance, a printing medium applicator, such as a squeegee, can be used to apply pressure to the screen, such that the printing medium passes through at least a portion of the screen and onto the substrate to be printed.

As noted above, at least a portion of the screen 120 can be coated with an emulsion 130 to form a pattern or image on the screen. The emulsion can, in some embodiments, block or substantially block the passage of the liquid medium through the coated portion of the screen. Accordingly, the pattern formed on the screen by the emulsion can, in some embodiments, be the reverse of the pattern printed on the substrate. Any emulsion compatible with the porous mesh screen material (including mesh count and thread diameter specification) and the liquid printing medium to be used can be contemplated within the scope of this disclosure. The emulsion can, for instance, be a liquid, and can have any density and/or capillary film properties. The emulsion may be coated onto the screen in any thickness suitable for screen printing applications. For instance, the emulsion may be coated onto the screen in a thickness that is up to about 50% of the thickness of the screen when attached to the frame, such as up to about 40%, up to about 30%, up to about 20%, or up to about 10% of the as-stretched thickness of the screen, including all ranges and subranges therebetween.

The emulsion 130 may be coated onto either or both sides of the screen 120. Moreover, the emulsion can coat any predetermined portion of the screen as desired to form the appropriate pattern or image on the three-dimensional substrate. In some embodiments, the screen can be defined in terms of a "print" or "stencil" area, in which the emulsion is purposefully removed to allow the liquid print medium to pass through the screen and onto the substrate. The remainder of the screen can, in various embodiments, be coated with the emulsion. In other embodiments, the flexibility of the screen can potentially be enhanced by removing the emulsion from areas of the screen other than the stencil area. For instance, the emulsion can be removed from the screen area just inside the frame perimeter to a distance in close proximity to the stencil area. The amount of emulsion present on the screen can vary depending on the desired image and/or the amount of screen flexibility desired. According to various embodiments, the screen area within about 5-10% of the frame perimeter can be free or substantially free of emulsion. For instance, referring to FIG. 2, it can be seen that a portion of the screen area near the frame perimeter is not coated with the emulsion.

In certain embodiments, a pattern can be formed on the screen by coating the entire screen with an emulsion, covering selected portions of the emulsion with a positive image film, and exposing the emulsion to UV radiation. The UV exposure can harden the exposed emulsion, whereas the emulsion covered by the film can remain soft, due to the film blocking the UV radiation. After hardening, the emulsion that was covered by the film can be washed away with water or any other suitable solvent for dissolving the emulsion. An image can thus be formed on the screen according to various embodiments of the disclosure.

The apparatuses disclosed herein may, in various embodiments, have one or more advantages such as cost savings, improved image resolution, and/or reduced mechanical complexity. For example, the disclosed apparatus can be utilized in standard 2D printing devices, using 2D process parameters and techniques (e.g., fixed screen and substrate location and/or substantially flat/planar frame) to print three-dimensional substrates, including convex and concave surfaces, single axis curvatures, biaxial curvatures, and compound curvatures for large format (e.g., greater than about 500 mm) substrates. Additionally, because the apparatuses can be used in standard printing devices, the need for custom tooling and machining and the expenses associated therewith can be eliminated. Moreover, because the substrate and frame locations can be fixed relative to each other, the need for additional moveable parts, e.g., for translating either the substrate or frame or both, can be eliminated, thereby cutting down on the cost and complexity of the printing process.

Furthermore, the framed screen apparatuses can also be "universal" in that one screen design can be used for any of the various curvatures noted above. Since the apparatus comprises a highly flexible screen attached to a rigid frame, the apparatus can be used on substrates of various sizes. In other words, if the size of the three-dimensional substrate increases it may not be necessary to likewise increase the size of the framed screen apparatus to accommodate the larger surface. This attribute may be advantageous because it can avoid the need for larger and more expensive printing machines otherwise needed to accommodate larger framed screens. It should be understood that the apparatuses according to the present disclosure may not exhibit one or more of the above advantages, but are still intended to fall within the scope of the disclosure.

Systems

Disclosed herein are systems for screen printing on a surface of a three-dimensional substrate comprising a framed screen and an applicator for applying a liquid printing medium to the three-dimensional substrate, wherein the framed screen comprises a substantially rigid, substantially planar frame having a perimeter defining a region within the perimeter having a given surface area; and a screen attached to the frame and extending across at least a portion of the surface area, wherein the screen comprises a first portion through which a liquid printing medium can pass onto a proximate three-dimensional substrate; and a second portion coated with an emulsion substantially preventing the liquid printing medium from passing through the second portion of the screen, wherein the screen has a fixed tension of less than about 20 N/cm.

Figure 3:
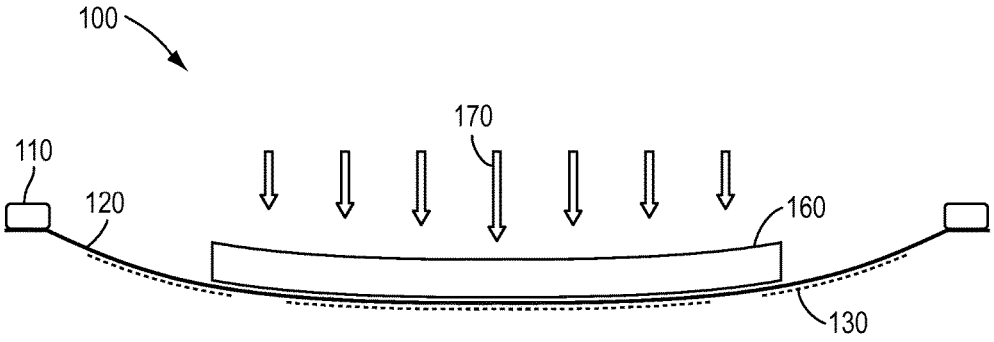
FIG. 3 illustrates a side view of an exemplary screen printing system according to one embodiment of the disclosure.

FIG. 3 illustrates a cross-sectional side view of screen printing system according to one aspect of the disclosure, in which an applicator 160 is brought into contact with a framed screen apparatus 100. The screen 120 is attached to the frame 110 and coated, at least in part, with an emulsion 130. In the illustrated embodiment, the emulsion 130 is coated on the lower surface of the screen 120, also referred to as the "printing" surface, although it is contemplated that the emulsion can also be coated onto the upper surface of the screen, also referred to as the "applicator" surface, or both. The liquid printing medium (not shown) can be applied to the screen and, using the applicator 160 to apply pressure to the screen, as represented by the arrows 170, at least a portion of the liquid printing medium can pass through the screen and onto the three-dimensional substrate. The applicator 160 may be flexible or rigid and the application pressure may be uniform or variable.

According to one exemplary embodiment, a flexible, pressure controlled applicator, such as a squeegee, may be used to print on the three-dimensional substrate, e.g., for substrates with complex curvature around more than one radius. A standard straight-edge squeegee, such as those used for 2D flat printing may also be used to print on the three-dimensional substrate, e.g., for substrates with a single radius of curvature. Other applicators such as brushes, spatulas, or the like, of varying shapes and sizes, are also contemplated and within the scope of the disclosure. The squeegee or any other applicator can be drawn along the screen, forcing at least some of the printing medium through at least a portion of the screen onto the three-dimensional substrate. The hold angle, pressure, draw speed, size, and hardness of the applicator can vary depending, e.g., on the desired image resolution.

According to various embodiments, the applicator can be a squeegee, which can comprise any material, such as rubber materials, polyurethanes, and the like. The applicator can be a single unit, such as a single squeegee, or can comprise segmented units, such as two or more adjacent or non-adjacent squeegees. In some embodiments the applicator may comprise a single piece which may, in various embodiments, be rectangular in shape, or can comprise multiple pieces. The applicator, e.g., squeegee, may comprise a working edge, which contacts the screen, optionally at an angle, and a fixed edge, which may be opposite the working edge and can be attached to the printing device using any suitable means. In non-limiting exemplary embodiments, the applicator can be a squeegee such as those disclosed, e.g., in U.S. Provisional Patent Application No. 62/032,138, entitled SQUEEGEE FOR PRINTING FLAT AND CURVED SUBSTRATES, filed by Applicant on Aug. 1, 2014, which is incorporated herein by reference in its entirety.

The printing medium can be a medium comprising one or more coloring agents, such as pigments, dyes, and the like. The printing medium can be in a liquid or substantially liquid form and can comprise at least one solvent, such as water, or any other suitable solvent. As used herein, the term "liquid" is intended to refer to any free-flowing medium having any viscosity suitable for screen printing. In certain embodiments, the liquid printing medium can be chosen from inks of various colors and shades. In other embodiments, the liquid printing medium can be chosen from non-pigmented mediums, such as clear lacquers or protective coatings, to name a few. The liquid printing medium can be chosen from colored, opaque, translucent, or transparent mediums and may serve a functional and/or decorative purpose.

The systems disclosed herein can further comprise various additional components. For example, a printing medium delivery component may be included, which can be configured to deliver a pre-determined amount of printing medium onto the screen. A distributor, such as a flood bar, may optionally be employed to distribute the printing medium across the screen, for example, in a substantially even fashion. Further, a means for gripping and/or translating the applicator can be included, as well as various other components typically present in a screen printing device.

Squeegee Apparatuses

Disclosed herein are squeegee apparatuses comprising a squeegee blade, a plurality of retainers spaced along a length of the squeegee blade and coupled to the squeegee blade, at least one support strip coupled to the plurality of retainers and extending along the length of the squeegee blade, and an actuating mechanism for applying a force to the squeegee apparatus in a direction substantially perpendicular to a print stroke direction. According to various embodiments, the at least one support strip can comprise two opposing end surfaces and two opposing support surfaces, the opposing support surfaces being substantially perpendicular to the direction of force.

Figure 4:
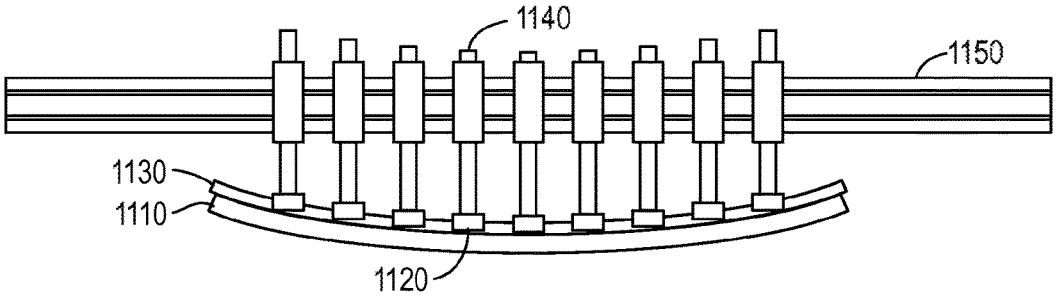
FIG. 4 illustrates a side view of an exemplary squeegee apparatus according to aspects of the disclosure.

FIG. 4 illustrates one embodiment of an exemplary squeegee apparatus according to the disclosure. The apparatus can comprise a squeegee blade 1110 which can be coupled to a plurality of retainers 1120 spaced along the length of the squeegee blade. At least one support strip 1130 can be coupled to the plurality of retainers 1120 and can extend along the length of the squeegee blade. The retainers 1120 can be coupled to an actuating mechanism 1140 for applying a force to the squeegee blade, such as hydraulic or pneumatic mechanisms, e.g., a plurality of actuators, which can optionally be coupled to a print beam 1150. The actuating mechanism 1140 can apply a force to the squeegee blade 1110, e.g., a downward force, which can be substantially evenly distributed along the length of the squeegee blade 1110 by the spaced apart retainers 1120 and the at least one support strip 1130.

As used herein the term "coupled to" and variations thereof is intended to denote that two components are in physical contact but are not necessarily physically attached, although physical attachment is contemplated in some aspects. For instance, the squeegee blade can be gripped by and coupled to the plurality of retainers. The at least one support strip can be coupled to the plurality of retainers by frictional forces, e.g., can extend through a cavity in the retainers and/or can be otherwise retained so as to float freely (e.g., able to move separately from the plurality of retainers).

The squeegee blade 1110 can be any blade suitable for screen printing, for example, a flexible squeegee blade, which can be used to distribute and/or force the liquid printing medium through the screen and onto the substrate. The squeegee blade may have a generally rectangular shape, although other shapes can be used and are envisioned. The squeegee blade can comprise a retention edge, which can be adapted to couple with the plurality of retainers, and a printing edge, which can be adapted to contact the screen and substrate. The printing edge of the squeegee blade can have any desired profile, such as a square edge, rounded edge, single-beveled edge, or double-beveled edge, as appropriate for a given application. According to various embodiments, the squeegee blade can be a straight-edge blade, e.g., the printing edge is linear. The printing edge of the squeegee blade can contact the substrate at a wide variety of angles, which can be adjusted as desired based on the given application.

The squeegee blade can be constructed from a flexible material, such as rubber materials and polyurethanes, to name a few. In certain embodiments, the squeegee blade is a non-metal, flexible material. According to various embodiments, the squeegee blade can be monolithic, e.g., a single blade not divided into separate blades or segments. The thickness and length of the squeegee blade can vary and can be selected according to the desired application. By way of non-limiting example, the length of the squeegee blade can range from about 20 mm to about 1 m or more, such as from about 50 mm to about 500 cm, from about 100 mm to about 250 cm, or from about 500 mm to about 100 cm, including all ranges and subranges therebetween. The thickness of the squeegee blade can range, in certain embodiments, from about 5 mm to about 10 mm or more, such as from about 6 mm to about 9 mm, or from about 7 mm to about 8 mm, including all ranges and subranges therebetween. The height of the squeegee blade can range, for instance, from about 10 mm to about 500 cm or more, such as from about 20 mm to about 250 cm, from about 50 mm to about 100 cm, or from about 100 mm to about 50 cm, including all ranges and subranges therebetween.

The plurality of retainers 1120 can have any configuration suitable for coupling to the squeegee blade 1110. For instance, the plurality of retainers can each comprise a retaining element for coupling with the retention edge of the squeegee blade. By way of non-limiting example, the retaining element can be chosen from clips or clamps for gripping the retention edge of the squeegee blade; slots, grooves, or channels into which the retention edge of the squeegee blade can slide, optionally in an interlocking fashion; one or more surfaces extending from the retainer to which the squeegee blade can be attached, e.g., using clips, clamps, screws, or any other suitable attachment device; and combinations thereof.

The retainers 1120 can be constructed from any suitable material including, but not limited to wood, metals, plastics, and polymeric materials. The retainers can be a segmented material derived from a larger monolith or can be fabricated individually. The retainers can, in some embodiments, have the same length or, in other embodiments, can have differing lengths. The retainers can be spaced equally apart or at varying distances. By way of non-limiting example, the length of the retainers can range from about 10 mm to about 150 mm, such as from about 25 mm to about 100, or from about 50 mm to about 75 mm, including all ranges and subranges therebetween. The retainers can be spaced apart by a distance ranging, for example, from about 10 mm to about 50 mm or more, such as from about 15 mm to about 45 mm, from about 20 mm to about 40 mm, or from about 25 mm to about 30 mm, including all ranges and subranges therebetween.

The plurality of retainers can comprise two or more retainers, such as three or more retainers, four or more retainers, five or more retainers, and so on. The number, spacing, and/or length of the retainers can be chosen according to a given application, substrate size, or substrate curvature. For example, in the case of screen printing on a 3D surface, retainers having a longer length may be placed along the length of the squeegee blade that corresponds to a flatter area of the substrate, whereas shorter retainers can be placed along the length of the squeegee blade that corresponds to an area of higher curvature. According to certain embodiments, for a concave substrate, longer retainers can be placed in the center of the squeegee blade and shorter retainers can be placed closer to the ends of the squeegee blade.

Figure 5:
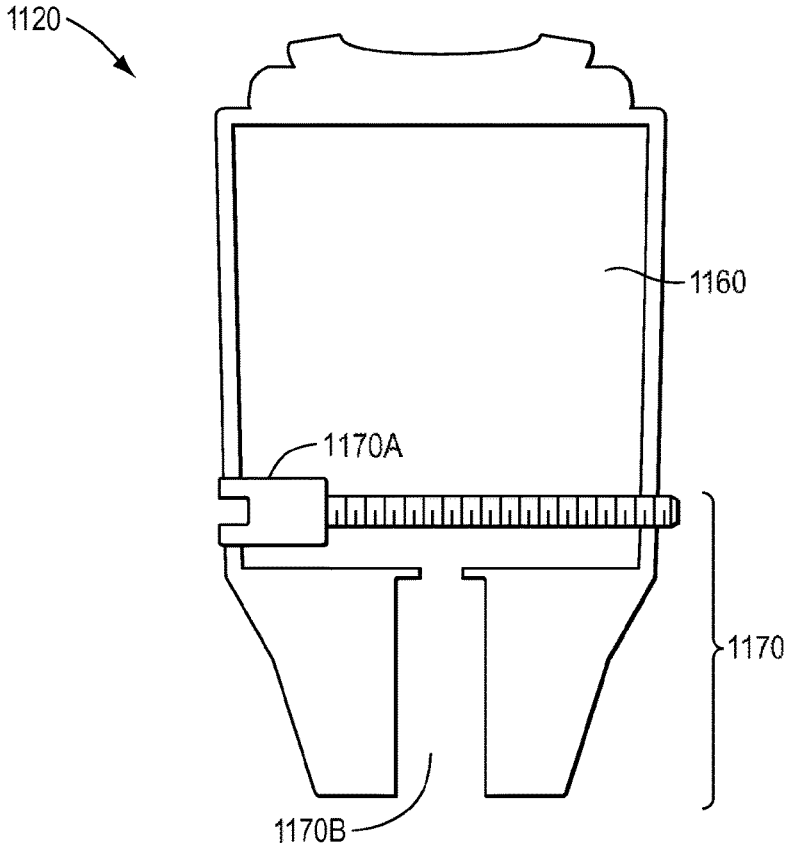
FIG. 5 illustrates a cross-sectional view of an exemplary retainer according to aspects of the disclosure.

Each retainer in the plurality of retainers 1120 can further comprise at least one cavity, which can be located adjacent to, e.g., above, the retention element. FIG. 5 shows a cross-sectional view of a retainer 1120 having a cavity 1160 and a retention element 1170. In the illustrated embodiment, the retention element 1170 comprises both a screw 1170A for clamping the squeegee blade (not shown) and a channel 1170B into which the squeegee blade can slide.

Figure 6:
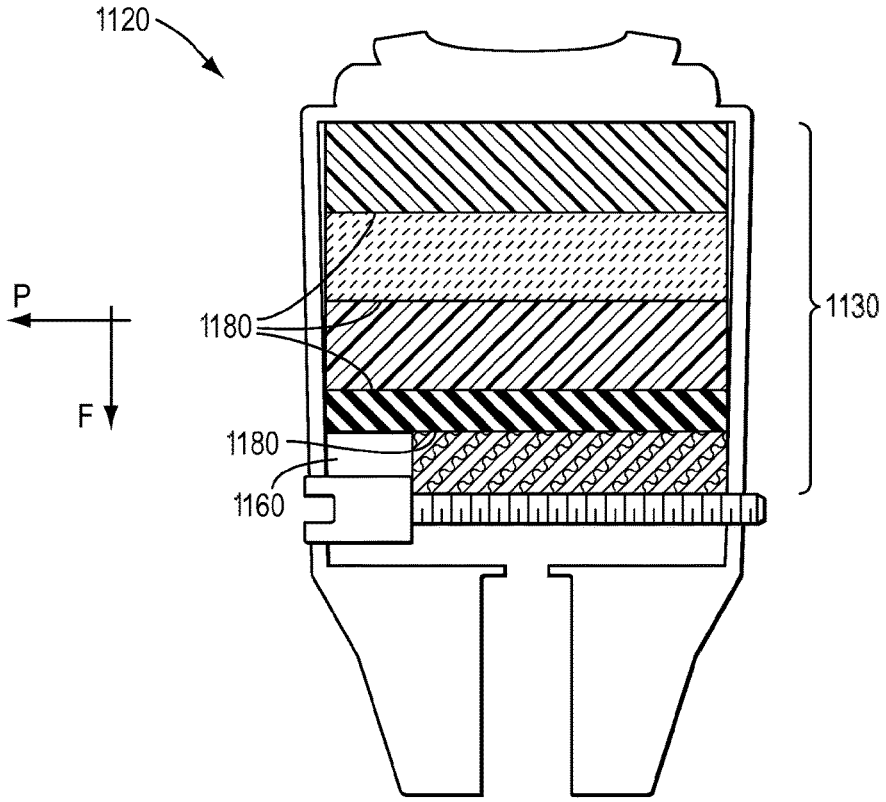
FIG. 6 illustrates a cross-sectional view of an exemplary retainer and stack of support strips according to aspects of the disclosure.

FIG. 6 illustrates a cross-sectional view of a retainer 1120 comprising a cavity 1160 into which a stack of support strips 1130 has been inserted. As illustrated, and as discussed in more detail herein, the support strips can have varying thicknesses and can be constructed from various different materials, depending on the desired flexural properties for the squeegee. Although FIGS. 5-6 illustrate a retainer comprising a cavity, it is to be understood that a cavity may not be present in the retainer, in which case the retainer may be equipped with an alternative means with which to couple to the stack of support strips, e.g., the stack may physically contact and freely float (move freely) with respect to the plurality of retainers.

In FIG. 6, the direction of force applied to the squeegee blade is indicated by the arrow F, whereas an exemplary print stroke direction is indicated by the arrow P. A stack of support strips 1130 can be arranged such that their opposing support surfaces 1180 are perpendicular to the direction of force F. It may be possible to allow flexure of the squeegee blade in the direction of force F, while also limiting or substantially limiting the flexure of the squeegee blade in the print stroke direction P. This exemplary configuration can be advantageous in that the spaced apart retainers 1120, in conjunction with the at least one support strip 1130, can distribute the downward force F across the length of the squeegee blade, while also retaining structural integrity in the print stroke direction P. It can thus be possible to provide separate, unlinked retainers that can withstand the mechanical strain of the print stroke. As such, according to certain embodiments, the plurality of retainers are not physically attached to one another, e.g., by rivets, and/or do not overlap with one another. This exemplary configuration can be further advantageous due to the lack of additional parts, such as rivets, which can wear out over time due to the mechanical strain caused by the print stroke.

The at least one support strip 1130 can comprise one or more support strips, such as two or more support strips, three or more support strips, four or more support strips, and so on, which may, in certain embodiments, be stacked. The terms "stack of support strips," "support strips," and variations thereof are used interchangeably herein with "at least one support strip" and are intended to denote one or more such support strips. The at least one support strip can comprise any material including, but not limited to, wood, metals, plastics, ultra-high molecular weight (UHMW) plastics, polymeric materials, phenolic resins, polypropylene materials, and combinations thereof. Each support strip can have the same or different composition and/or thickness. The thickness, number, and/or order of the support strips in the stack can vary and may depend, e.g., on the manner in which it is coupled to the retainers and/or the desired flexibility or tension of the squeegee apparatus. According to various embodiments, one or more of the support strips, e.g., in a stack, can comprise different materials and/or can have a different dimension, such as thickness, from other strips in the stack. Additionally, the support strips can each comprise more than one material, such as a first material inset in a second material, for instance, a metal strip surrounded by another material such as a plastic, or three or more inlaid materials, and so on. These materials and combinations thereof can be chosen as appropriate to achieve the desired flexure of the at least one support strip.

The support strips 1130 can have any suitable shape and/or orientation. In one exemplary embodiment, the at least one support strip can have a solid or hollow cross-section, for example, one or more of the support strips can comprise at least one void, such as a hole or other shape, along the length, width, or thickness of the strip. The void can extend partially or fully through the strip. Such voids can be, e.g., machined or drilled into the strips as desired to achieve the desired flexure of the strips and/or to reduce the weight of the squeegee apparatus.

As illustrated in FIG. 6, in some embodiments, the at least one support strip 1130 can be a stack of support strips, such as strips having a substantially rectangular or square cross-section. The support surfaces 1180 can, according to various embodiments, be planar or substantially planar. The opposing support surfaces can be separated, e.g., by a thickness of the support strip. According to certain embodiments, each support strip can comprise two opposing side surfaces, separated by a width of the support strip. The width can be, in exemplary embodiments, larger than the thickness of the support strip.

The support surfaces 1180 of one support strip can, for example, abut the support surfaces of one or more support strips, such as two adjacent planar surfaces, or interlocking non-planar surfaces. The support surfaces 1180 can, in certain embodiments, be non-planar. For example, the at least one support strip 1130 can have a round or rounded cross-section, e.g., oval or circular to name a few. The at least one support strip 1130 can also, in certain embodiments, comprise at least one hollow body, such as a pneumatic or hydraulic bladder, which can be changed in shape and/or size by, e.g., changing the pressure in the bladder, to achieve a desired flexure of the support strip and/or to couple as desired to the plurality of retainers.

In the case of multiple support strips, such as a stack of support strips, it can be possible to include a retaining mechanism for securing or loosely securing the strips to one another. For instance, the support strips could each comprise a void at one or both ends of the strip, which may be substantially concentric, such that a fastening means, e.g., a bolt, nut, or any other suitable fastening means, can hold the stack together.

In some embodiments, such as the embodiment illustrated in FIG. 6, the plurality of retainers can comprise cavities and the stack of support strips can be configured to fit within the cavities. In this non-limiting embodiment, the thickness of the at least one support strip (or stack of support strips) can be chosen to substantially match the height of the retainer cavities. The width of the at least one support strip (or stack of support strips) can likewise be chosen to substantially match the width of the retainer cavities. Any other dimension of the at least one support strip can be chosen to match a dimension of the retainer cavity. The at least one support strip can thus fit snugly ("press fit") in the retainer cavities to enable flexure of the squeegee blade in the direction of force applied while also inhibiting flexure in the print stroke direction. It should be noted that the strips can be individually placed in the retainer cavities to form a stack, or a stack can be pre-formed and then placed in the retainer cavities. It should also be noted that while the support strips 1130 are illustrated adjacent and above the screw 1170A, the claims appended herewith should not be so limited as it is envisioned that the support strips 1130 can be positioned below the screw 1170A and/or the screw 1170A or other suitable affixing mechanism can penetrate one or more support strips 1130.

Methods

Further disclosed herein are methods for screen printing a surface of a three-dimensional substrate comprising positioning the three-dimensional substrate in proximity to a framed screen, the framed screen comprising a substantially rigid, substantially planar frame having a perimeter defining a region within the perimeter having a given surface area; and a screen attached to the frame and extending across at least a portion of the surface area, wherein the screen comprises a first portion through which a liquid printing medium can pass onto a proximate three-dimensional substrate; and a second portion coated with an emulsion substantially preventing the liquid printing medium from passing through the second portion of the screen, wherein the screen has a fixed tension of less than about 20 N/cm; and applying pressure to the screen to force a portion of the liquid printing medium through the first portion of the screen onto the three-dimensional substrate, wherein the distance between the frame and the three-dimensional substrate is held substantially constant during the application steps.

The methods disclosed herein can be used to print or decorate a three-dimensional substrate. Decorating or printing as disclosed herein can be used to describe the application of a coating, which can be functional and/or aesthetic, of any liquid material having any suitable viscosity onto a three-dimensional substrate. The three-dimensional substrate can be chosen from substrates of varying compositions, sizes, and shapes. For example, the substrate may comprise a glass, ceramic, glass-ceramic, polymeric, metal, and/or plastic material. Exemplary substrates can include, but are not limited to, glass sheets, molded plastic parts, metal parts, ceramic bodies, glass-glass laminates, and glass-polymer laminates.

The three-dimensional substrate may have any shape or thickness, for instance, a thickness ranging from about 0.1 mm to about 100 mm or more, depending, e.g., on the size and/or orientation of the printing device. For instance, the three-dimensional substrate may have a thickness ranging from about 0.3 mm to about 20 mm, from about 0.5 mm to about 10 mm, from about 0.7 mm to about 5 mm, from about 1 mm to about 3 mm, or from about 1.5 mm to about 2.5 mm, including all ranges and subranges therebetween. The three-dimensional substrate may have a single radius of curvature or multiple radii, such as two, three, four, five, or more radii. The radius of curvature may, in some embodiments, be greater than about 500 mm, such as greater than about 600 mm, greater than about 700 mm, greater than about 800 mm, greater than about 900 mm, or greater than about 1,000 mm, including all ranges and subranges therebetween.

According to the methods disclosed herein, a liquid printing medium can be applied to and optionally spread across the screen using any means described herein. An applicator may then be used to apply pressure to the screen to force a portion of the liquid printing medium through at least a portion of the screen onto the three-dimensional substrate. According to various embodiments, the applicator can contact the screen in a single pass, which may be sufficient to transfer the liquid printing medium to the three-dimensional substrate, or the applicator can make several passes. Any applicator as described herein can be used to carry out the disclosed methods.

As used herein, the term "off-contact" distance is intended to refer to the distance between the substantially rigid, planar frame and the substrate surface. Off-contact also refers to the distance at which the screen is held away from the substrate both immediately prior to printing and immediately after printing. In other words, the off-contact distance is the distance the screen must travel to contact the substrate. According to the methods disclosed herein, the distance between the frame and the three-dimensional substrate is held substantially constant during the application of the liquid printing medium and the application of pressure. The frame and the substrate can be held in fixed positions relative to each other. When pressure is applied to the screen, e.g., using an applicator, the screen can move to contact the substrate, but the frame can be held in substantially the same position. The off-contact distance can be greater than the off-contact distance used for 2D printing (e.g., about 1-10 mm) and can theoretically be unlimited using the methods disclosed herein. By way of non-limiting example, the off-contact distance can be greater than about 100 mm, greater than about 75 mm, greater than about 50 mm, greater than about 25 mm, or greater than about 10 mm, including all ranges and subranges therebetween.

After the printing medium is applied to the three-dimensional substrate, various additional steps can be performed such as, for example, drying the printed medium to remove one or more solvents, curing the printed medium, removing the substrate from the printing machine, placing the substrate under vacuum, and/or cleaning the substrate, to name a few. According to various embodiments, the pattern can be corrected and/or adjusted using the methods disclosed, e.g., in U.S. Provisional Patent Application No. 62/032,125, entitled METHODS FOR SCREEN PRINTING THREE-DIMENSIONAL SUBSTRATES AND PREDICTING IMAGE DISTORTION, filed by Applicant on Aug. 1, 2014, which is incorporated herein by reference in its entirety.

It will be appreciated that the various disclosed embodiments may involve particular features, elements or steps that are described in connection with that particular embodiment. It will also be appreciated that a particular feature, element or step, although described in relation to one particular embodiment, may be interchanged or combined with alternate embodiments in various non-illustrated combinations or permutations.

It is also to be understood that, as used herein the terms "the," "a," or "an," mean "at least one," and should not be limited to "only one" unless explicitly indicated to the contrary. Thus, for example, reference to "an emulsion" includes examples having two or more such emulsions unless the context clearly indicates otherwise. Likewise, a "plurality" is intended to denote "more than one."

Ranges can be expressed herein as from "about" one particular value, and/or to "about" another particular value. When such a range is expressed, examples include from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

The terms "substantial," "substantially," and variations thereof as used herein are intended to note that a described feature is equal or approximately equal to a value or description. For example, a "substantially planar" surface is intended to denote an object that is planar or approximately planar. Moreover, as defined herein, "substantially similar" is intended to denote that two values or objects are equal or approximately equal.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

While various features, elements or steps of particular embodiments may be disclosed using the transitional phrase "comprising," it is to be understood that alternative embodiments, including those that may be described using the transitional phrases "consisting" or "consisting essentially of," are implied. Thus, for example, implied alternative embodiments to a system that comprises A+B+C include embodiments where a system consists of A+B+C and embodiments where a system consists essentially of A+B+C.

It will be apparent to those skilled in the art that various modifications and variations can be made to the present disclosure without departing from the spirit and scope of the disclosure. Since modifications combinations, sub-combinations and variations of the disclosed embodiments incorporating the spirit and substance of the disclosure may occur to persons skilled in the art, the disclosure should be construed to include everything within the scope of the appended claims and their equivalents.

What is claimed is:

1. A screen printing system for printing on a surface of a three-dimensional substrate, the system comprising:

(a) a substantially rigid, substantially planar frame having a perimeter defining a region within the perimeter having a given surface area;

(b) a screen attached to the frame and extending across at least a portion of the surface area, the screen comprising:

(i) a first portion through which a liquid printing medium can pass onto a proximate three-dimensional substrate; and (ii) a second portion coated with an emulsion substantially preventing the liquid printing medium from passing through the second portion of the screen;

wherein the screen has a fixed tension of no more than 15 N/cm; and (c) a squeegee apparatus comprising:

a squeegee blade; and a plurality of retainers spaced along the squeegee blade and coupled to the squeegee blade;

wherein the plurality of retainers can be adjusted to change the shape of the squeegee blade.

2. The screen printing system of claim 1, wherein the screen comprises at least one porous mesh material.

3. The screen printing system of claim 1, wherein the plurality of retainers comprise at least three retainers.

4. The screen printing system of claim 1, wherein the screen comprises one or more of:

(i) a plain, twill, double twill, crushed, or flattened weave pattern;

(ii) a mesh count ranging from about 120 threads/inch to about 380 threads/inch; or (iii) a thread diameter ranging from about 30 microns to about 80 microns.

5. The screen printing system of claim 1, wherein the screen has a fixed tension ranging from about 10 N/cm to about 14 N/cm.

6. The screen printing system of claim 1, wherein the squeegee apparatus comprises at least one support strip coupled to the plurality of retainers and extending along a length of the squeegee blade.

7. The screen printing system of claim 6, wherein each of the plurality of retainers comprises a cavity, and wherein the at least one support strip extends through the cavities.

8. The screen printing system of claim 6, wherein the at least one support strip extends along a top of the squeegee blade.

9. The screen printing system of claim 6, wherein the at least one support strip is moveable separately from the plurality of retainers.

10. The screen printing system of claim 1, wherein the squeegee apparatus comprises an actuating mechanism configured to apply force to the squeegee blade in a direction perpendicular to a print stroke direction.

11. The screen printing system of claim 10, wherein the squeegee apparatus is configured to allow flexure of the squeegee blade in the direction of applied force and limit flexure of the squeegee blade in the print stroke direction.

12. The screen printing system of claim 1 wherein a vertical position of each of the plurality of retainers can be adjusted to change the shape of the squeegee blade.

13. A method of screen printing the surface of the three-dimensional substrate using the screen printing system of claim 1 comprising:

positioning the three-dimensional substrate in proximity to the screen, the surface of the three-dimensional substrate being non-planar;

applying the liquid printing medium to the screen; and applying variable pressure to the screen with the squeegee blade to force a portion of the liquid printing medium through the first portion of the screen onto the non-planar surface of the three-dimensional substrate.

14. The method of claim 13, wherein the distance between the frame and the surface of the three-dimensional substrate is substantially constant as the liquid printing medium is forced through the first portion of the screen onto the surface of the three-dimensional substrate.

15. The method of claim 13, wherein the surface of the three-dimensional substrate comprises at least one of glass, ceramic, glass-ceramic, metal, plastic, or polymeric material.

16. The method of claim 15, wherein the surface of the three-dimensional substrate comprises at least one of glass or glass-ceramic.

17. The method of claim 13, wherein the distance between the frame and the surface of the three-dimensional substrate is about 10 mm to about 100 mm.

18. The method of claim 13, wherein the screen has a fixed tension ranging from about 10 N/cm to about 14 N/cm.

19. The method of claim 13, wherein the three-dimensional substrate includes a vehicle sunroof.

20. The method of claim 13, wherein the surface of the three-dimensional substrate comprises a plurality of radii of curvatures.

21. The method of claim 13, wherein the surface of the three-dimensional substrate comprises a compound curvature.

22. The screen printing system of claim 1, wherein the plurality of retainers include separate retainers spaced apart from each other along a lengthwise direction of the squeegee blade.

* * * * *